United States Patent [19]

Dieterle et al.

[11] Patent Number: 4,731,519

[45] Date of Patent: Mar. 15, 1988

[54] CURLING IRON ADAPTED TO PROVIDE UNIFORM HEAT WHEN USED WITH EITHER DOMESTIC OR FOREIGN VOLTAGES

[75] Inventors: Wayne D. Dieterle, South Plainfield; Harry A. Wansaw, Plainfield, both of N.J.

[73] Assignee: Conair Corporation, Edison, N.J.

[21] Appl. No.: 826,380

[22] Filed: Feb. 5, 1986

[51] Int. Cl.[4] ..... H05B 1/02; H05B 3/40; A45D 1/04

[52] U.S. Cl. ..... 219/225; 132/37 R; 219/240; 219/250; 219/255; 219/485; 219/488; 219/501

[58] Field of Search ..... 219/222–226, 219/236–241, 364, 370, 250, 255, 485, 488, 501; 132/37 A, 37 R, 9

[56] References Cited

U.S. PATENT DOCUMENTS

| | | | |
|---|---|---|---|
| 2,069,929 | 11/1936 | De Los Santos | 219/488 |
| 2,215,029 | 9/1940 | Braun | 219/250 |
| 2,507,736 | 5/1950 | Ritchie et al. | 219/240 |
| 2,648,757 | 8/1953 | Harper | 219/241 |
| 3,095,493 | 6/1963 | Downing | 219/250 |
| 3,934,597 | 1/1976 | McNair | 219/222 |
| 4,100,397 | 7/1978 | Kunimi | 219/225 X |
| 4,267,430 | 5/1981 | Downey | 219/225 X |
| 4,490,602 | 12/1984 | Ishihara | 219/370 |

FOREIGN PATENT DOCUMENTS

| | | | |
|---|---|---|---|
| 167679 | 2/1951 | Austria | 219/240 |
| 1289545 | 2/1962 | France | 219/240 |
| 198840 | 10/1938 | Switzerland | 219/225 |
| 564388 | 9/1944 | United Kingdom | 219/240 |
| 646328 | 11/1950 | United Kingdom | 219/255 |
| 1144251 | 3/1966 | United Kingdom | 219/250 |
| 1470769 | 4/1977 | United Kingdom | 219/240 |

*Primary Examiner*—Anthony Bartis
*Attorney, Agent, or Firm*—Haynes N. Johnson

[57] ABSTRACT

An electric curling iron operative to provide uniform heating at both domestic (120 v) and foreign (240 v) voltages includes first and second rope-type electric heaters disposed side by side in the heatable barrel of the curling iron. The heaters are of the same configuration, coextensive in length with each other and the length of the barrel and are separated from each other by a sheet of electrical insulating material dividing the barrel longitudinally into two compartments each containing one of the heaters. A double throw switch on the curling iron enables energization of the first heater alone at the domestic voltage and both heaters in series at the foreign voltage, the relative resistances of the heaters being selected to produce the same output wattage whether the first heater alone or both heaters are energized. A half-wave rectifier may be provided in series with both heaters and be selectively switchable into and out of circuit therewith to produce high and low heat output rates at either domestic or foreign voltages.

6 Claims, 5 Drawing Figures

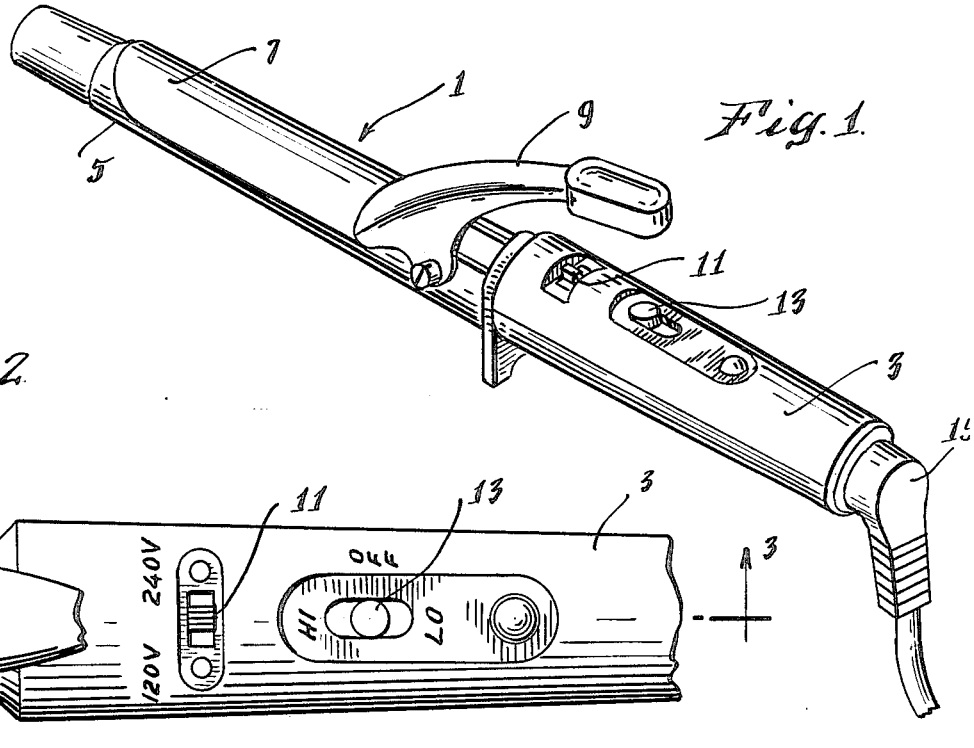
Fig. 1.
Fig. 2.
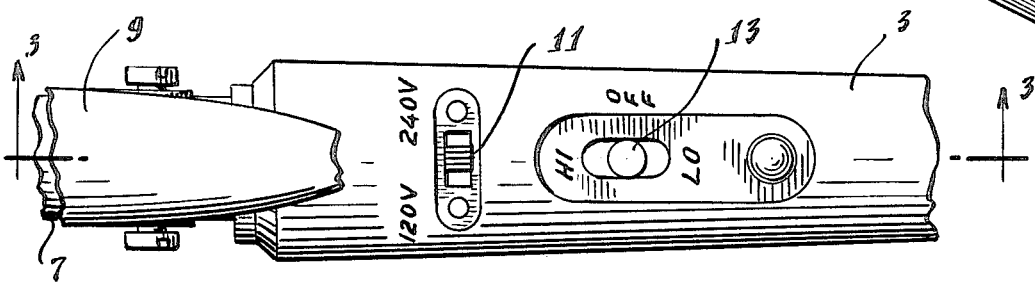
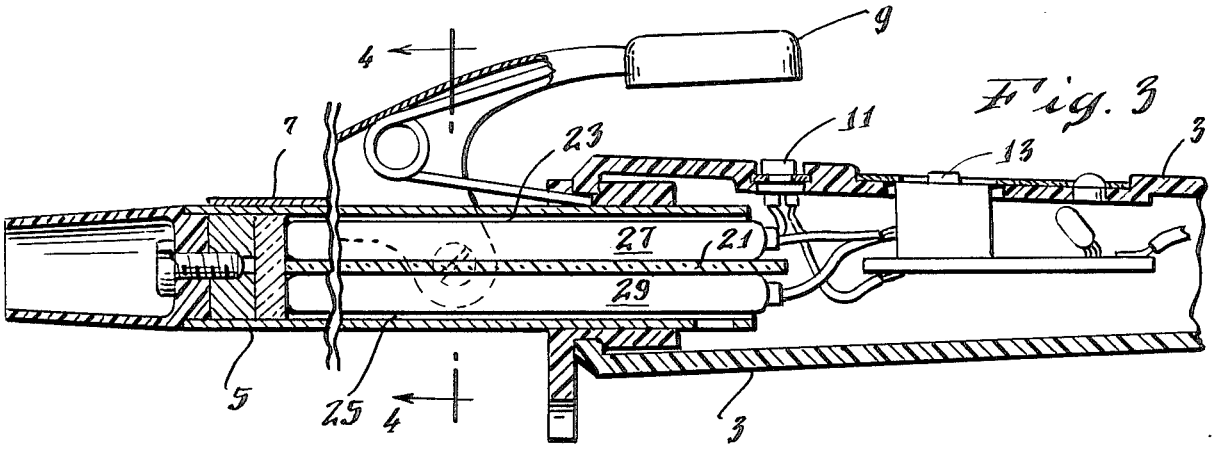
Fig. 3
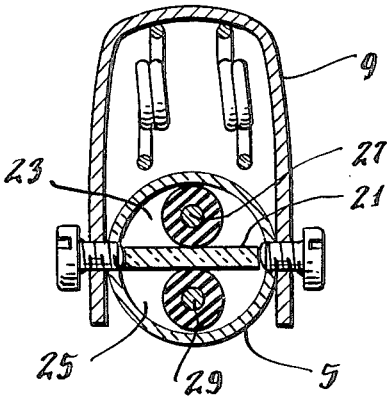
Fig. 4.
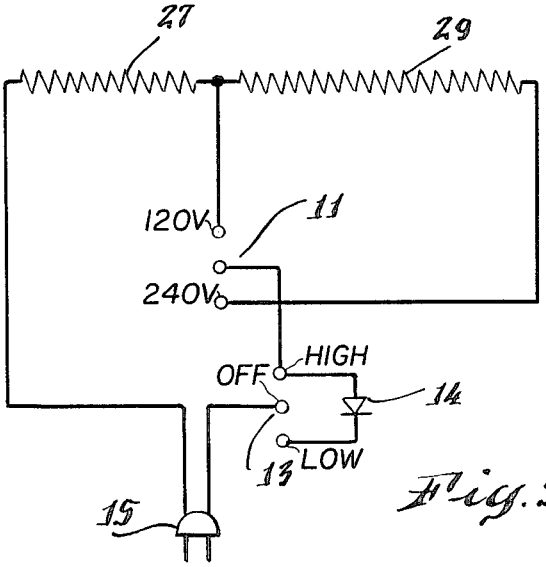
Fig. 5.

CURLING IRON ADAPTED TO PROVIDE UNIFORM HEAT WHEN USED WITH EITHER DOMESTIC OR FOREIGN VOLTAGES

FIELD OF THE INVENTION

This invention relates to the field of electrical curling irons and, in particular, to curling irons that can alternatively be used with domestic voltages (120 volts a.c.) and with foreign voltages (240 volts a.c.). This is done without the need for transformers and will produce approximately the same heat level with either voltage.

BACKGROUND OF THE INVENTION

Curling irons are often designed for specific voltages, either that normally found in the United States (about 120 volts a.c.) or that found in many European countries (about 240 volts a.c.). If, then, the curling iron is used in a country for which it has not been designed, an auxiliary transformer is used to adjust the voltage. If a transformer is not used, the unit will produce different temperatures with the different voltages, or may even burn out. Compensating circuits, such as voltage dividers have proven either cumbersome or expensive.

SUMMARY OF THE DISCLOSURE

A curling iron is provided which is adapted to operate at both domestic and foreign voltages and yet provide comparable heat levels at either of the voltages. The curling iron includes a generally cylindrical handle, a hollow barrel secured to the handle preferably in axial alignment, and means such as a clamp or a spoon to hold hair in contact with the barrel. A pair of electrical resistance elements are fitted longitudinally within the barrel and may be separated by insulating material such as mica.

These resistance elements, preferably rope heaters, have relative resistances such that the output wattage of the curling iron is substantially the same when the first element is used with the domestic voltage as when both elements, in series, are used with the foreign voltage. A slide switch is used to alternatively interconnect one element with the domestic voltage or both elements in series with the foreign voltage. The result is that substantial uniformity of barrel temperature may be obtained irrespective of which voltage is being used. A half-wave rectifier may also be used in the circuit to reduce the voltage and provide for a lower heat level.

DETAILED DESCRIPTION OF THE DRAWINGS

Turning to the drawings:

FIG. 1 is a perspective view of the curling iron of my invention.

FIG. 2 is a top plan view showing a portion of the handle and the slide switch used to switch between domestic and foreign voltages.

FIG. 3 is a longitudinal, vertical section primarily of the barrel portion of the curler showing the two longitudinal compartments within the barrel, each of which contains a rope heater.

FIG. 4 is a transverse section across the barrel, taken on line 4—4 of FIG. 3, showing the rope heaters within the barrel.

FIG. 5 is a circuit diagram for the switch used to set the curling iron for the voltage being used, and its relationship to the resistance elements. A half-wave rectifier may be added in series to set the curling iron at a lower temperature.

DETAILED DESCRIPTION OF THE DISCLOSURE

The drawings show the curling iron 1 of my invention with handle 3 and hollow cylindrical barrel 5. Preferably, the handle is of a generally cylindrical shape and the barrel is in axial alignment with it. The usual type of clamp or spoon 7 is spring-pressed against a portion of barrel 5 and is controlled by spring-pressed control lever 9.

The handle carries the usual type of temperature control switch 13 and the voltage-compensation switch 11. The electrical cord inlet is shown at 19.

Barrel 5 is divided into two longitudinal compartments 23 and 25 by a sheet of insulating material 21, such as mica. Curling iron 1 uses two electrical resistance elements 27 and 29 for heating the barrel 5. One of them is in each of the compartments. Rope heaters are good types of electrical resistance heating elements to be used in this kind of curling iron, not only for their practical value, but also because they come in "standard" wattage ratings which, by use of our invention, can be made to produce the uniform heating levels for both voltages.

The rope heaters 27 and 29 have resistances of sizes such that, as used in the circuit, the curling iron has about the same output wattage, and so temperature, whether domestic (120 volts a.c.) or foreign (240 volts a.c.) voltages are used. When using domestic voltage only the first element 27 is used; when using foreign voltage elements 27 and 29 are both used, in series. To achieve uniform lower temperatures at both voltages, a half-wave rectifier 14 may be placed in series with the resistances.

By way of example, element 27 might be 654.5 ohms and element 29, 2057.1 ohms. Using element 27 with domestic voltage of 120 volts would result in a current of 0.18 amperes and a wattage of $I^2R$ of about 22 watts. If foreign voltage of 240 volts is used, and the elements 27 and 29 are in series, the current will be about 0.09 amperes, or a wattage of $I^2R$ of about 21.24 watts. These output wattages are comparable within the required Underwriters Laboratories acceptable commercial range for wattages of +5% and −10%.

Examples of pairs of acceptable resistances and their resulting output wattages for the different input voltages are given in the following table:

| R 27 | Watts (120 v.) | R 29 | Watts (240 v.) |
|---|---|---|---|
| 1028.6 | 14 | 2880 | 14.7 |
| 900 | 16 | 2400 | 17.5 |
| 720 | 20 | 2057.1 | 20.74 |
| 654.5 | 22 | 2057.1 | 21.24 |

The "R 27" and "R 29" columns give the respective resistances in ohms. The second column gives the output wattage when R 27 is in the 120 volt circuit; and the last column gives the output wattage when both resistances are in series in the 240 volt circuit.

FIG. 5 depicts the type of circuit required to accomplish this balance of voltages. Slide switch 11 is a double throw switch, so wired as to include only resistance element 27 in the circuit when in its upper position (as shown in FIG. 5) and both resistance elements 27 and 29, in series, when in the lower position. Accordingly, switch 11 would be in the first position when domestic voltage is being used and in the second position when foreign voltage is being used.

Consequently, by utilizing resistance elements 27 and 29 that are so selected as to give currents that will result in relatively uniform output wattages regardless of which voltage is being used, one can have a curling iron that provides substantially the same heat level for either voltage situation. That is, the output wattages, and so the curling iron temperatures, would be approximately the same for either voltage. It is, of course, possible to have resistances of such exact ohmage as to give identical wattages; practicality, however, suggests that reasonable approximations to equal outputs are sufficient.

If desired, the circuit may include a high-low temperature, double throw switch 13 and a half-wave rectifier 14. Switch 13 will include rectifier 14 in series in the circuit when in one position, and will cut it out of the circuit when in the other. When rectifier 14 is in the circuit, the output wattage, for either position of switch 11, is approximately half of what it would otherwise be.

I claim:

1. A curling iron adapted to operate at both domestic and foreign voltages and yet provide comparable, uniform heat levels at either said voltage, said curling iron including a generally cylindrical handle, a heatable barrel secured to said handle in axial alignment therewith, and means associated with said barrel to hold hair in contact therewith, electrical heating means within said barrel and extending the length thereof, said heating means including a first and a second electrical resistance element, said elements being rope heaters positioned side by side within said barrel, being of the same configuration and being coextensive in length with each other and with the length of said barrel, said elements being separated by an electrical insulator, and having relative resistances such that the output wattage of said curling iron is substantially the same when said first element is energized alone with said domestic voltage as when both said elements are energized in series at said foreign voltage, and means to alternatively interconnect said first element alone with a source of said domestic voltage and both said elements in series with said foreign voltage, whereby uniformity of barrel temperature may be obtained irrespective of which said voltage is used.

2. A curling iron as set forth in claim 1 in which said interconnecting means is a double-throw slide switch positioned in said handle.

3. A curling iron as set forth in claim 1 in which said voltage is AC and including a rectifier and switch means for alternatively inserting and removing said rectifier from being in series with said resistance elements.

4. A curling iron adapted to operate at both domestic and foreign voltages and yet provide comparable, uniform heat levels at either said voltage, said curling iron including a handle, a hollow cylindrical barrel secured to said handle, and means associated with said barrel to hold hair in contact therewith, insulating sheet dividing said barrel longitudinally into two side by side compartments, a first and a second electrical resistance element positioned within said barrel and being substantially coextensive in length with each other and with the length of said barrel, one of said elements being positioned in each of said compartments and extending the length thereof, and means for selectively interconnecting one of said elements to a source of said domestic voltage, or both of said elements in series to a source of said foreign voltage, said elements having relative resistances such that the output wattage is the same for either of said interconnections with its respective voltage.

5. A curling iron as set forth in claim 4 in which said elements are rope heaters.

6. A curling iron as set forth in claim 4 in which said interconnecting means is a double throw slide switch mounted in said handle.

* * * * *